US008210277B2

(12) United States Patent
Umeda et al.

(10) Patent No.: US 8,210,277 B2
(45) Date of Patent: Jul. 3, 2012

(54) HOUSINGS FOR POWER TOOLS

(75) Inventors: Kenji Umeda, Anjo (JP); Satoshi Ninagawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 518 days.

(21) Appl. No.: 12/289,235

(22) Filed: Oct. 23, 2008

(65) Prior Publication Data

US 2009/0107691 A1 Apr. 30, 2009

(30) Foreign Application Priority Data

Oct. 25, 2007 (JP) ..... 2007-277475

(51) Int. Cl.
*B25F 5/02* (2006.01)

(52) U.S. Cl. ..... 173/171; 173/217

(58) Field of Classification Search ..... 173/213, 173/216, 217, 171; 220/677
See application file for complete search history.

(56) References Cited

U.S. PATENT DOCUMENTS

| | | | | |
|---|---|---|---|---|
| 2,239,090 | A * | 4/1941 | Everett | 173/115 |
| 2,337,343 | A * | 12/1943 | Para | 401/192 |
| 3,007,603 | A * | 11/1961 | Krehl | 220/618 |
| 3,123,109 | A * | 3/1964 | Bork | 30/388 |
| 3,912,887 | A * | 10/1975 | Gratz et al. | 200/16 D |
| 3,989,331 | A * | 11/1976 | Hanlon | 439/70 |
| 4,219,125 | A * | 8/1980 | Wiltshire et al. | 220/4.13 |
| 4,641,762 | A * | 2/1987 | Overy | 220/4.21 |
| 4,770,316 | A * | 9/1988 | Overy | 220/677 |
| 4,936,063 | A * | 6/1990 | Humphrey | 52/200 |
| 5,692,574 | A * | 12/1997 | Terada | 173/162.2 |
| 6,109,366 | A * | 8/2000 | Jansson et al. | 173/216 |
| 6,934,969 | B2 * | 8/2005 | Schorr et al. | 2/51 |
| 7,673,703 | B2 * | 3/2010 | Fischer et al. | 173/217 |
| 7,845,427 | B2 * | 12/2010 | Wan et al. | 173/162.1 |
| 2006/0033290 | A1 * | 2/2006 | Fuchs et al. | 277/553 |

FOREIGN PATENT DOCUMENTS

| | | |
|---|---|---|
| JP | A-5-23978 | 2/1993 |
| JP | U-5-20879 | 3/1993 |

* cited by examiner

*Primary Examiner* — Lindsay Low
(74) *Attorney, Agent, or Firm* — Oliff & Berridge, PLC

(57) ABSTRACT

A housing for a power tool includes a plurality of housing segments assembled together to form the housing. A gap is produced between mating surfaces of at least two housing segments positioned adjacent to each other. A capillary action preventing device disposed at the gap and constructed to interrupt a path of flow of a liquid caused by a capillary action from the inside to the outside of the housing along the gap.

17 Claims, 4 Drawing Sheets

HOUSINGS FOR POWER TOOLS

This application claims priority to Japanese patent application serial number 2007-277475, the contents of which are incorporated herein by reference.

BACKGROUND OF THE INVENTION

1. Field of the Invention

The present invention relates to housings for power tools and, in particular to housings that accommodate drive sources, such as electric motors, of power tools.

2. Description of the Related Art

In general, in a power tool having an electric motor as a drive source, the output of the motor is amplified (i.e., the rotational speed of the motor is decreased) by engagement of gears (i.e., a gear train) and is thereafter outputted from an output shaft. The gear train is interleaved between the motor and the output shaft and is accommodated within a gear chamber defined generally within a housing. Grease or lubrication oil is sealingly contained within the gear chamber for the purpose of lubrication of the gear train. The housing generally has a structure split into right and left halves along a lengthwise direction (a motor axis direction) taking into account of ease of assembling and performing the maintenance work.

The split housing has a problem that the oil component of the grease may leak from the gear chamber to the outside via a small gap produced between mating surfaces of the housing halves due to a capillary action during a long time use. In order to prevent the grease oil component from leaking to the outside, Japanese Laid-Open Patent Publication No 5-23978 has proposed a technique of sealing between the mating surfaces of the housing halves. According to this technique, a groove is formed in one of the mating surfaces and a rib is formed on the other of the mating surfaces. The groove and the rib are engaged with each other with a resilient seal member interleaved therebetween. Japanese Laid-Open Utility Model Publication No. 5-20879 has proposed another sealing technique, in which an additional wall for preventing the grease from leaking is provided on the outer side of a wall part that defines the gear chamber, so that the grease can be prevented from leaking by a double wall structure.

However, in the case of the sealing technique of Japanese Laid-Open Patent Publication No. 5-23978, the recess and the rib are necessary to be provided at the mating surfaces of the housing halves. In addition, the separate sealing member is necessary to be interleaved between the mating surfaces. Therefore, the cost of dies for molding the housing halves may increase. In addition, the number of parts may increase. As a result, the manufacturing cost of the housing may increase. Also, in the case of the sealing technique of Japanese Laid-Open Utility Model Publication No. 5-20879, the manufacturing cost may increase because it is necessary to provide the additional wall.

Therefore, there has been a need for a housing for a power tool, which can prevent or minimize the leakage of liquid without substantial increase in the manufacturing cost.

SUMMARY OF THE INVENTION

One aspect according to the present invention includes a housing for a power tool which includes a plurality of housing segments assembled together to form the housing. A gap is produced between mating surfaces of at least two housing segments positioned adjacent to each other. A capillary action preventing device is disposed at the gap and constructed to interrupt a path of flow of a liquid caused by a capillary action from the inside to the outside of the housing along the gap.

DETAILED DESCRIPTION OF THE INVENTION

Figure 1:
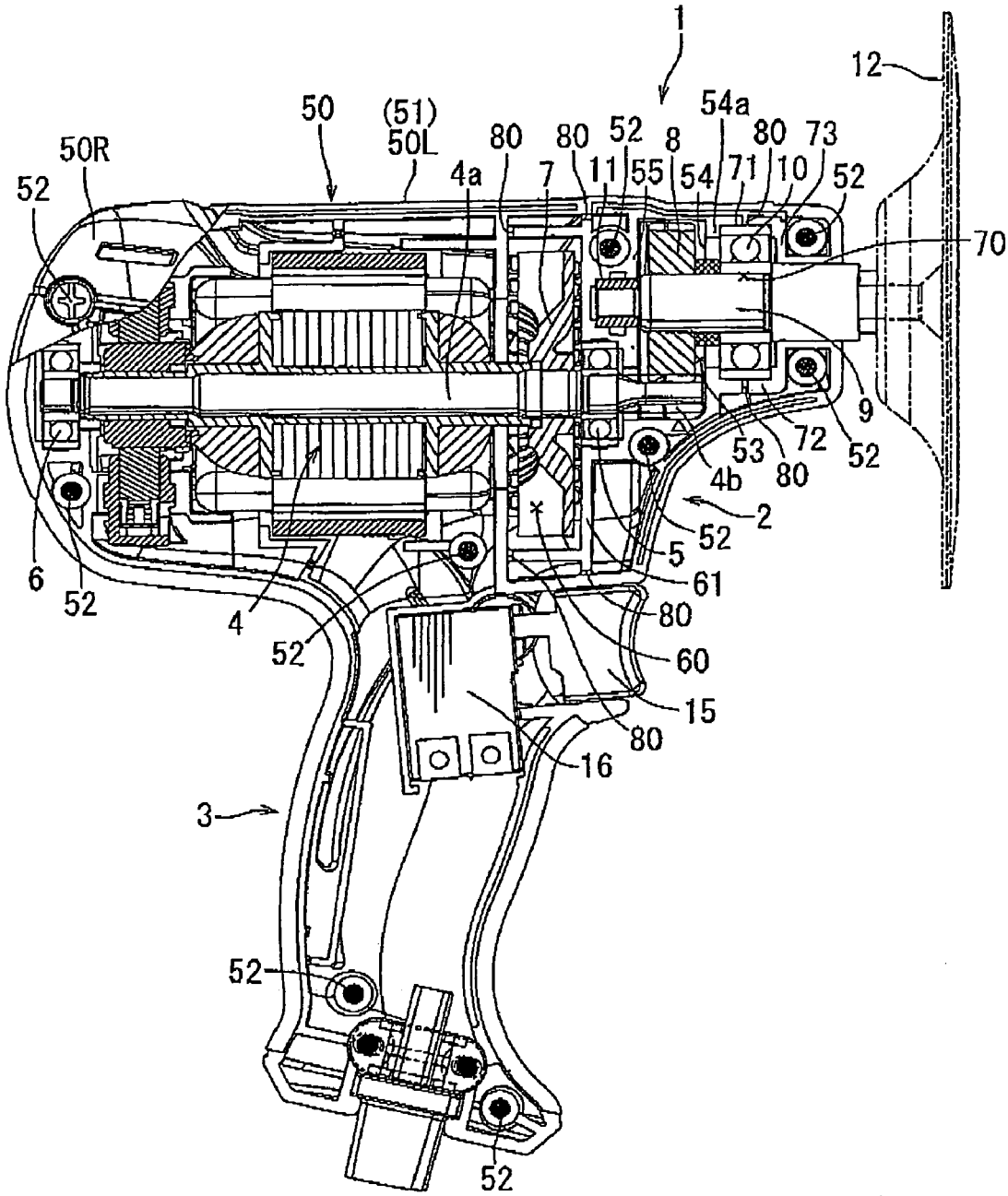
FIG. 1 is a side view of a power tool incorporating a housing according to a first embodiment of the present invention with a right housing half removed to show the internal structure of the power tool.

Each of the additional features and teachings disclosed above and below may be utilized separately or in conjunction with other features and teachings to provide improved housings for power tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a power tool has a reduction gear mechanism coupled to a drive source for reducing a rotational output of the drive source. The housing for the power tool includes a first housing half and a second housing half. The first housing half has a first mating surface. The second housing half has a second mating surface configured to be mated with the first mating surface of the first housing half within a plane extending substantially in a lengthwise direction of the power tool, while a gap is produced between the first and second mating surfaces. Each of the first and second housing halves includes an outer frame and an inner wall formed integrally with each other. The inner wall includes a first wall and a second wall. The first walls of the first and second housing halves cooperate with each other to define at least a part of a gear chamber that can receive the reduction gear mechanism therein. The second wall is formed in continuity with the first wall. The outer frames of the first and second housing halves define a first part of the gap. The first walls of the first and second housing halves define a second part of the gap. The second walls of the first and second housing halves define a third part of the gap. A capillary action preventing device disposed at least one of the first, second and third parts of the gap and constructed to interrupt a path of flow of a liquid caused by a capillary action along the at least one of the first, second and third parts of the gap. Preferably, the capillary action preventing device is disposed at the third part of the gap.

With this arrangement, because the path of flow of a liquid caused by a capillary action along the at least one of the first, second and third parts of the gap is interrupted by the capillary action preventing device, it is possible to prevent liquid, in particular oil contents of grease contained within the gear chamber, from leaking to the outside via the gap.

The capillary action preventing device may include a first recess formed in a part of the first mating surface of the first housing half defining the at least one of the first, second and third parts of the gap, so that the path of flow of the liquid is broadened by the first recess. The capillary action preventing device may further include a second recess formed in a part of the second mating surface of the second housing half defining the at least one of the first, second and third parts of the gap, so that the path of flow of the liquid is broadened by the second recess. The first recess and the second recess may be positioned to be opposed to each other.

With this arrangement, the manufacturing costs can be reduced because no projection is necessary to be formed on the mating surfaces and because no sealing member is required. In addition, the first recess and/or the second recess may enable the liquid to be retained by the surface tension.

In another embodiment, the capillary action preventing device is a porous material disposed within the at least one of the first, second and third parts of the gap.

In a further embodiment, the capillary action preventing device includes a recess and a projection. The recess is formed in a part of the first mating surface of the first housing half defining the at least one of the first, second and third parts of the gap. The projection is formed oh a part of the second mating surface of the second housing half defining the at least one of the first, second and third parts of the gap. The projection includes a seal portion resiliently deformable to sealingly contact with a bottom of the recess when the projection is engaged with the recess as the first and second housing halves are assembled with each other.

With this arrangement, because the seal portion of the projection seals the gap, it is possible to prevent liquid, in particular oil contents of grease contained within the gear chamber, from leaking to the outside via the gap. In addition, because the seal portion is integrated with the projection, no separate sealing member is necessary to be provided. Further, in the case that the housing halves are molded by using dies, the addition of the seal portion does not require substantial changes to the dies. Therefore, the manufacturing cost may not be increased. Further, the capillary action preventing device does not require any change to the assembling operation of the housing halves.

A first embodiment of the present invention will now be described with reference to FIGS. 1 to 5. Referring to FIG. 1, a hand-held power tool 1 includes a housing 50 having a main body section 2 and a handle section 3. An electric motor 4 as a power source is disposed within a rear part (left part as viewed in FIG. 1) of the main body section 2. In this embodiment, the power tool 1 is a disk sander.

An output shaft 4*a* of the motor 4 is rotatably supported by a front bearing 5 and a rear bearing 6 and extends along a lengthwise direction of the power tool 1. A cooling fan 7 is attached to the output shaft 4*a* at a position on the rear side (left side) of the bearing 5. A gear portion 4*b* is formed with the front end of the output shaft 4*a* positioned on the front side (right side) of the bearing 5. The gear portion 4*b* is in engagement with a drive gear 8 that is fixedly mounted to a spindle 9. The spindle 9 is rotatably supported within the housing 50 via a front bearing 10 and a rear bearing 11. In this embodiment, a ball bearing is used as the front bearing 10 and a metal bush is used as the rear bearing 11. The front end of the spindle 9 extends beyond the front end of the housing 50. A circular grinding wheel 12 as a working tool is mounted to the front end of the spindle 9.

The handle section 3 is configured such that an operator can grasp the handle section 3 with his or her one hand. A trigger or a switch lever 15 is mounted to a base end (an upper end as viewed in FIG. 1) of the handle section 3. When the operator pulls the switch lever 15 by his or her fingers while grasping the handle 3 with his or her one hand, a main switch 16 is turned on and outputs an ON signal to the motor 4, so that the motor 4 is started. The rotation of the motor 4 is reduced by the engagement between the output gear portion 4*b* and the drive gear 8 and is thereafter transmitted to the spindle 9 to rotate the grinding wheel 12.

The housing 50 has a split structure and includes a left housing half 50L and a right housing half 50R. The housing halves 50L and 50R are split by a plane extending substantially in a longitudinal direction of the power tool 1 and are abutted to each other at their mating surfaces. In this embodiment, the longitudinal direction is an axial direction of the output shaft 4*a* of the motor 4, which extends in right and left directions as viewed in FIG. 1. In FIG. 1, a major part of the left housing half 50L positioned on the left side as viewed from the front side (right side as viewed in FIG. 1) in the longitudinal direction of the power tool 1 is shown, while only a part of a rear portion of the right housing half 50R is shown.

Each of the housing halves 50L and 50R has a first part and a second part formed integrally with the first part. The first part corresponds to half of the main body section 2 and the second part corresponds to half of the handle section 3. The housing half 50R is substantially symmetrical with the housing half 50L. Therefore, the configurations of the housing halves 50L and 50R will be explained only for the housing half 50L.

The housing half 50L has an outer frame 51 and wall portions disposed inside of the outer frame 51 and formed integrally with the outer frame 51. The outer frame 51 defines the outer surface of the housing half 50L. The wall portions may serve as support portions for supporting various mechanical parts disposed within the housing 50 and may also serve as ribs for reinforcing the housing half 50L from the inner side.

Figure 2:
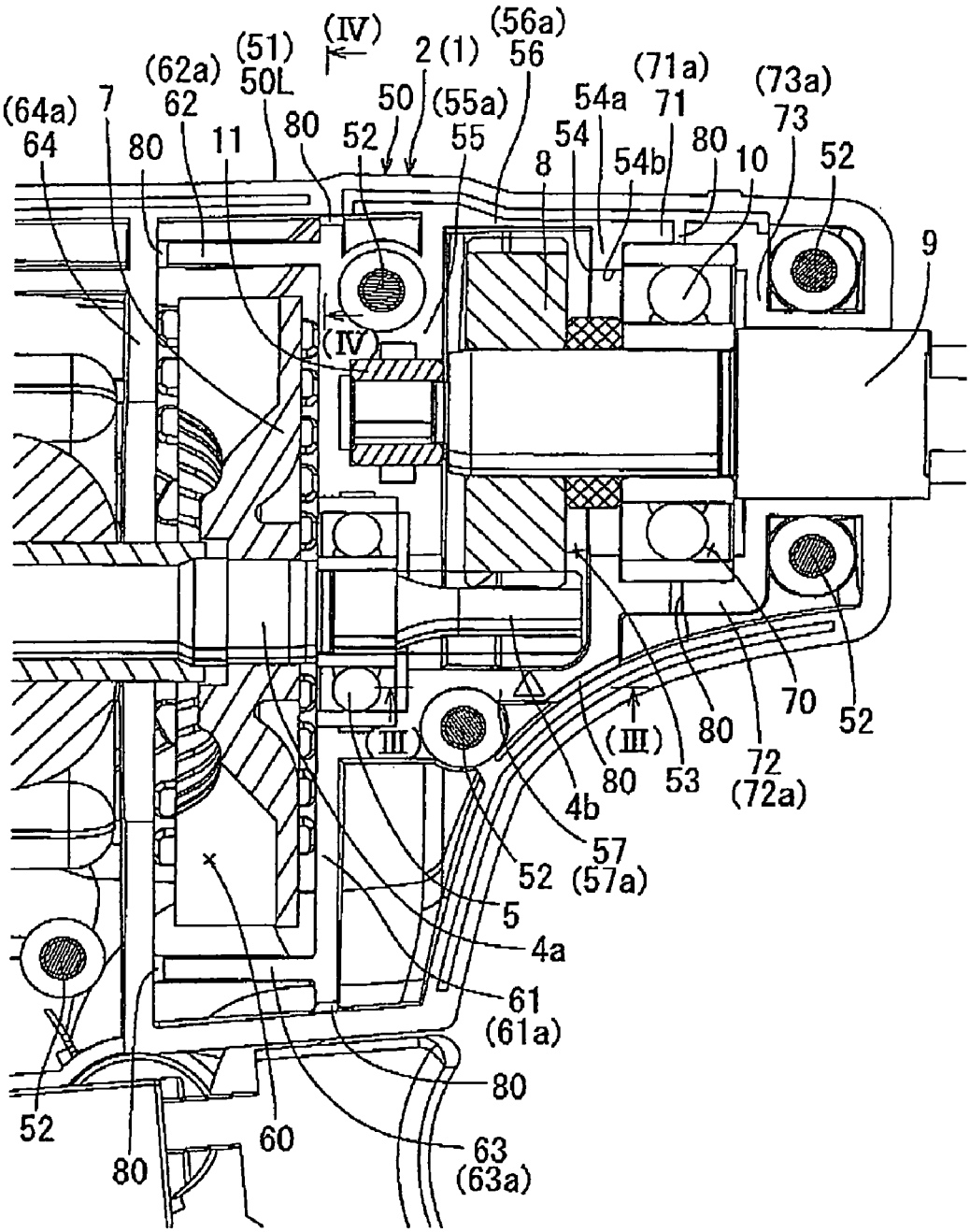
FIG. 2 is an enlarged view of a part of FIG. 1 and showing a gear chamber and its related structure.

As shown in FIG. 2, a gear chamber 53 is defined within a front portion of the main body section 2 of the housing 50 for accommodating the output gear portion 4*b* of the motor 4 and the drive gear 8. The wall portions of the housing half 50L include gear chamber wall parts 54 to 57. The gear chamber wall parts 54 to 57 of the housing half 50R and those of the housing half 50L cooperate with each other to define the gear chamber 53. Grease or lubricating oil is substantially sealingly contained within the gear chamber 53 for lubricating the engaging region between the output gear portion 4*b* and the drive gear 8. Therefore, transmission of power may be effectively performed and the life of the output gear portion 4*b* as well as the life of the drive gear 8 can be extended. It is also possible to reduce the noise that may be produced at the engaging region.

The gear chamber wall part 54 of the housing half 50L and that of the housing half 50R cooperate with each other to define the front side wall (right side wall as viewed in FIG. 2) of the gear chamber 53. The spindle 9 extends through an insertion hole 54*b* formed in the central portion of the front side wall. The front side wall also serves as a rear side wall of a bearing chamber 70 that receives the front bearing 10 therein.

The wall portions of the housing half 50L also include an upper bearing chamber wall part 71, a lower bearing chamber wall part 72 and a front bearing chamber wall part 73. The upper bearing chamber wall part 71 of the housing half 50L and that of the housing half 50R cooperate with each other to define the top wall of the bearing chamber 70. The lower bearing chamber wall part 72 of the housing half 50L and that of the housing half 50R cooperate with each other to define the bottom wall of the bearing chamber 70. The front bearing chamber wall part 73 of the housing half 50R and that of the housing half 50L cooperate with each other to define the front wall of the bearing chamber 70.

Further, the gear wall chamber wall part 56 of the housing half 50L and that of the housing half 50R cooperate with each other to define the top wall of the gear chamber 53. The gear chamber wall part 57 of the housing half 50L and that of the housing half 50R cooperate with each other to define the bottom wall of the gear chamber 53. The gear chamber wall part 55 of the housing half 50R and that of the housing half 50L cooperate with each other to define the rear wall of the gear chamber 53. The rear bearing 11 for rotatably supporting the spindle 9 is mounted between the gear chamber wall parts 55 of the housing halves 50R and 50L.

A fan chamber wall part 61 is formed integrally with the gear chamber wall part 55, so that the fan chamber wall part 61 of the housing half 50R and that of the housing half 50L cooperate with each other to define the front wall of a fan chamber 60. The front bearing 5 for rotatably supporting the output shaft 4*a* of the motor 4 is mounted between the fan chamber wall parts 61 of the housing halves 50R and 50L. The cooling fan 7 is positioned within the fan chamber 60.

The wall portions of the housing half 50L further include an upper fan chamber wall part 62, a lower fan chamber wall part 63 and a rear fan chamber wall part 64. The upper fan chamber wall part 62 of the housing half 50L and that of the housing half 50R cooperate with each other to define the top wall of tie fan chamber 60. The lower fan chamber wall part 63 of the housing half 50L and that of the housing half 50R cooperate with each other to define the bottom wall of the fan chamber 60. The rear fan chamber wall part 64 of the housing half 50R and that of the housing half 50L cooperate with each other to define the rear wall of the fan chamber 60.

Figure 3:
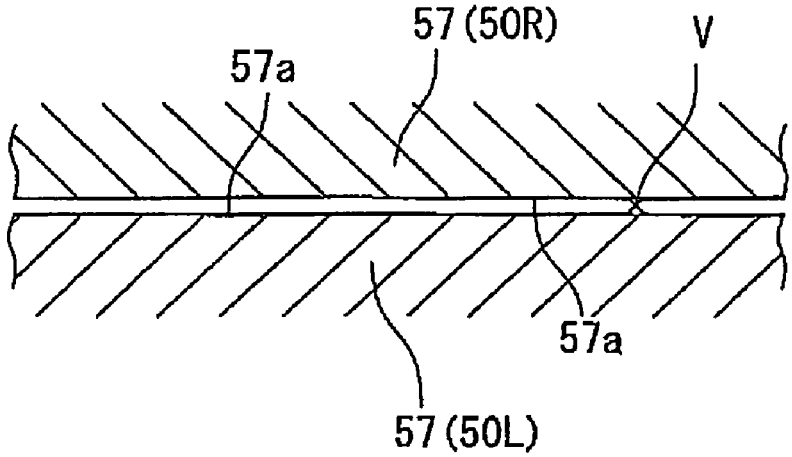
FIG. 3 is a cross sectional view taken along line III-III in FIG. 2.

As described above, within the front portion of the housing 50, the fan chamber 60 accommodating the cooling fan 7 therein, the gear chamber 53 accommodating the output gear portion 4*b* and the dive gear 8 and containing the grease therein and the bearing chamber 70 accommodating the bearing 10 therein are arranged in this order with respect to a direction forwardly along the lengthwise direction. The chambers 60, 53 and 70 may be formed as the housing halves 50L and 50R are assembled such that the housing halves 50L and 50R abut to each other from right and left directions at their mating surfaces. In the abutted state of the housing halves 50L and 50R or the assembled state of the housing 50, it may be possible that a small gap V is formed between the mating surfaces of the housing halves 50L and 50R (see FIG. 3). In FIG. 2, portions of the mating surfaces of the wall parts 61 to 64 defining the chamber 60, the wall parts 54 to 57 defining the chamber 53 and the wall parts 71 to 73 defining the chamber 70 are labeled with reference numerals 61*a* to 64*a*, 54*a* to 57*a* and 71*a* to 73*a*, respectively. As shown in FIG. 3, the gap V formed between the portions 57*a* of the mating surfaces of the housing halves 50L and 50R may allow the grease (mainly the oil contents of the grease) to leak to the outside via the gap V due to a capillary action.

The leakage due to the capillary action also may be caused at the portions 61*a* to 64*a* of the wall parts 61 to 64 of the fan chamber 60, the portions 54*a* to 56*a* of the wall parts 54 to 56 of the gear chamber 53, and the portions 71*a* to 73*a* of the wall parts 71 to 73 of the bearing chamber 70. Therefore, according to this embodiment, a technique is incorporated to interrupt the capillary action in the midway of the path of leakage to the outside, so that the oil contents of the grease contained within the gear chamber 53 may not leak to the outside. In particular, according to this embodiment, at least one capillary action preventing device 80 for interrupting the capillary action is provided in the midway of leakage from each of the fan chamber 60, the gear chamber 53 and the bearing chamber 70 to the outside.

More specifically, a plurality of capillary action preventing devices 80 are incorporated including two provided at upper and lower positions, respectively, of each of the front fan chamber wall parts 61, one provided at each of the upper fan chamber wall parts 62, one provided at each of the lower fan chamber wall parts 63, one provided at each of the upper bearing chamber wall parts 71, one provided at each of the lower bearing chamber wall parts 72, and one provided along the joint portion that joins the front gear wall part 54 and the lower gear wall part 57 to the outer frame 51 of each of the housing halves 50L and 50R. Therefore, seven capillary action preventing devices 80 are provided in each of the housing halves 50L and 50R. The devices 80 of the housing half 50L are positioned to be opposed to the devices 80 of the housing half 50R.

Figure 4:
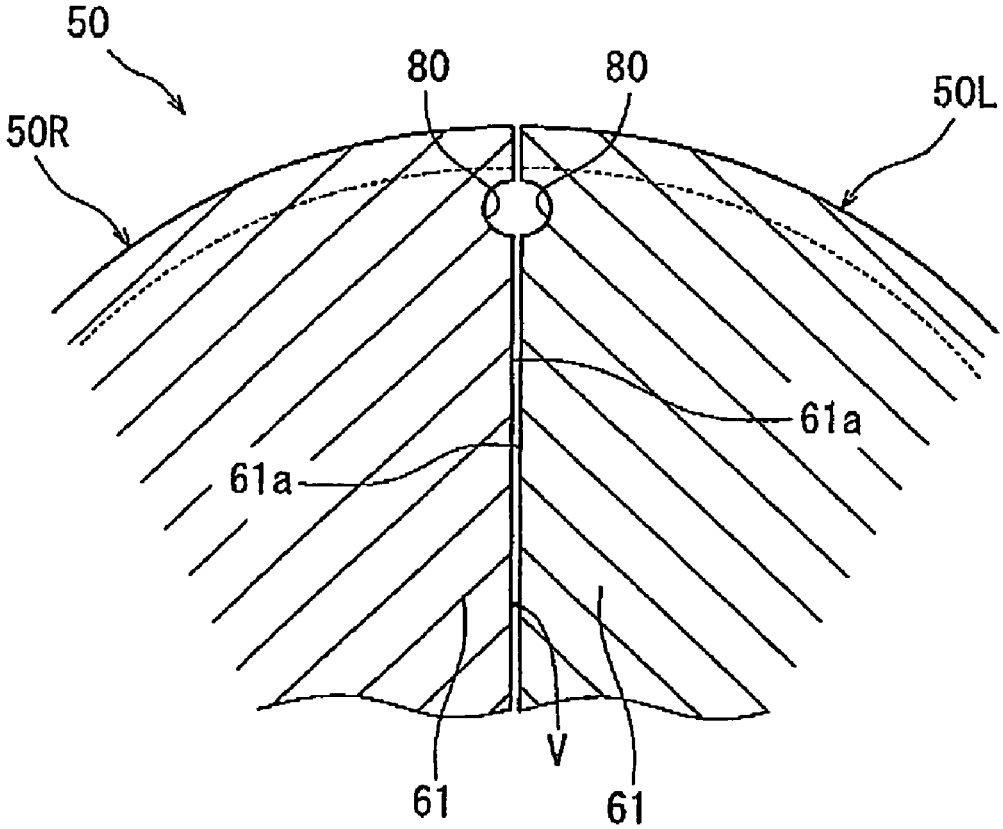
FIG. 4 is a cross sectional view taken along line IV-IV in FIG. 2.

In this embodiment, each of the capillary action preventing devices 80 is configured as a recess. The details of the devices 80 provided at the upper position of the front fan chamber wall parts 61 are shown in FIG. 4. As shown in FIG. 4, each of the devices 80 is configured as a semicircular recess formed in the portion 61*a* of each of the mating surfaces of the front wall parts 61 of the housing halves 50L and 50R and extends across the corresponding front wall part 61 in a direction of the width (i.e., a direction of the thickness) of the portion 61*a*. Therefore, the gap V between the portions 61*a* is broadened at the devices 80, so that the capillary action may be interrupted at the devices 80. Hence, the oil contents of the grease within the gear chamber 53, which may flow along the gap V due to the capillary action, may be prevented from flowing radially outward over the devices 80. As a result, the oil contents of the grease may be prevented from leaking to the outside of the housing 50.

As shown in FIG. 2, the devices 80 on the side of the fan chamber 60 are disposed at four positions where the wall parts of each housing halves are joined to the other wall parts in a T-shaped manner. The devices 80 on the side of the bearing chamber 70 are disposed at two positions including a substantially central position in the lengthwise direction of the upper bearing chamber wall parts 71 and a substantially central position in the lengthwise direction of the lower bearing chamber wall parts 72. The device 80 provided along the joint portion that joins the front gear wall part 54 and the lower gear wall part 57 to the outer frame 51 of each of the housing halves 50L and 50R is configured to have a curved configuration to conform to the configuration of the outer frame 51.

As described above, according to the housing 10 of this embodiment, the capillary action preventing devices 80 are provided at seven positions of the wall parts of each of the housing halves 50L and 50R and include two provided at upper and lower positions, respectively, of each of the front fan chamber wall parts 61, one provided at each of the upper fan chamber wall parts 62, one provided at each of the lower fan chamber wall parts 63, one provided at each of the upper bearing chamber wall parts 71, one provided at each of the lower bearing chamber wall parts 72, and one provided along the joint portion that joins the front gear wall part 54 and the lower gear wall part 57 to the outer frame 51 of each of the housing halves 50L and 50R. Therefore, although the oil contents of the grease contained in the gear chamber 53 may flow into the fan chamber 60 and/or the bearing chamber 70 through a part of the gap V formed between the portions 54*a* to 57*a* of the wall parts 54 to 57 of the housing half 50L and those of the housing half 50R, which define the gear chamber 53, the capillary action interrupting devices 80 may prevent the oil contents from leaking to the out side via a part of the gap V formed between the portions 61*a* to 64*a* of the wall parts 61 to 64 of the housing half 50L and those of the housing half 50R and/or a part of the gap V formed between the portions 71a to 73a of the wall parts 71 to 73 of the housing half 50L and those of the housing half 50R. Therefore, the leakage of the oil contents of the grease to the outside of the housing 50 can be reliably prevented in comparison with the known double wall structure.

In addition, with the capillary action interrupting devices 80 of this embodiment, the gap V between the mating surfaces abruptly changes to have a large size. Therefore, the flow of the oil contents of the grease that may leak from the gear chamber 53 may be blocked at the devices 80 due to the surface tension of the oil contents. The leakage of the oil contents to the outside may be prevented also in this respect.

Further, because no sealing rubber is used, the number of parts and the manufacturing cost may not be increased.

The above embodiment may be modified in various ways. For example, the positions and the number of the capillary action preventing devices 80 may be arbitrarily detained. In particular, the number of the positions of the devices 80 may not be limited to seven. Thus, the devices 80 may be provided by any suitable number and by any suitable positions as long as the devices 80 are each operable to interrupt the capillary action at a portion of a path of leakage of the oil contents of the grease via the small gap V defined between the wall parts (other than those defining the gear chamber 53) of the housing half 50L and those of the housing half 50R.

Although the devices 80 are configured as semicircular recesses in the above embodiment, the recesses of the devices 80 may be configured to have any other configurations, such as a rectangular configuration and a triangular configuration. In addition, although the devices 80 are provided on both of the mating surfaces of the housing halves 50L and 50R, they may be provided on only one of the mating surfaces of the housing halves 50L and 50R.

Further, although the devices 80 are configured as recesses, the devices 80 may not be limited to recesses as long as they can interrupt the capillary action. For example, the devices 80 may be porous materials, such as sponges, disposed within the paths of flow that may be caused by the capillary action.

A second embodiment of the present invention will now be described with reference to FIG. 5, which shows only a part of a power tool similar to the power tool of the first embodiment. Other than the construction shown in FIG. 5, the construction of the power tool of this embodiment is the same as the first embodiment. A housing 90 of this embodiment also has a split structure and includes a left housing half 91 and a right housing half 92. The housing halves 91 and 92 are split by a plane extending substantially along a longitudinal direction of the power tool and assembled such that they abut to each other at mating surfaces 91*b* and 92*b* formed on outer frames 91*a* and 92*a* of the housing halves 91 and 92, respectively. A projection 93 is formed on one of the mating surfaces 91*b* and 92*b*, while a recess 94 for receiving the projection 93 is formed in the other of the mating surfaces 91*b* and 92*b*. In this embodiment, the projection 93 is formed on one of the mating surface 92*b* and the recess 94 is formed in the mating surface 91*b*. The projection 93 may be fitted into the recess 94 as the housing halves 91 and 92 are assembled to each other to form the housing 90.

A seal portion 95 is formed integrally with the end surface (upper surface as viewed in FIG. 5) of the projection 93 and has a substantially triangular configuration with its pointed end oriented upward, so that the seal portion 95 can resiliently deform. Therefore, as the projection 93 is fitted into the recess 94, the seal portion 95 is pressed against the bottom of the recess 94 so as to be resiliently deformed. In this embodiment, the projection 93 is bent leftward as shown in FIG. 5.

Figure 5:
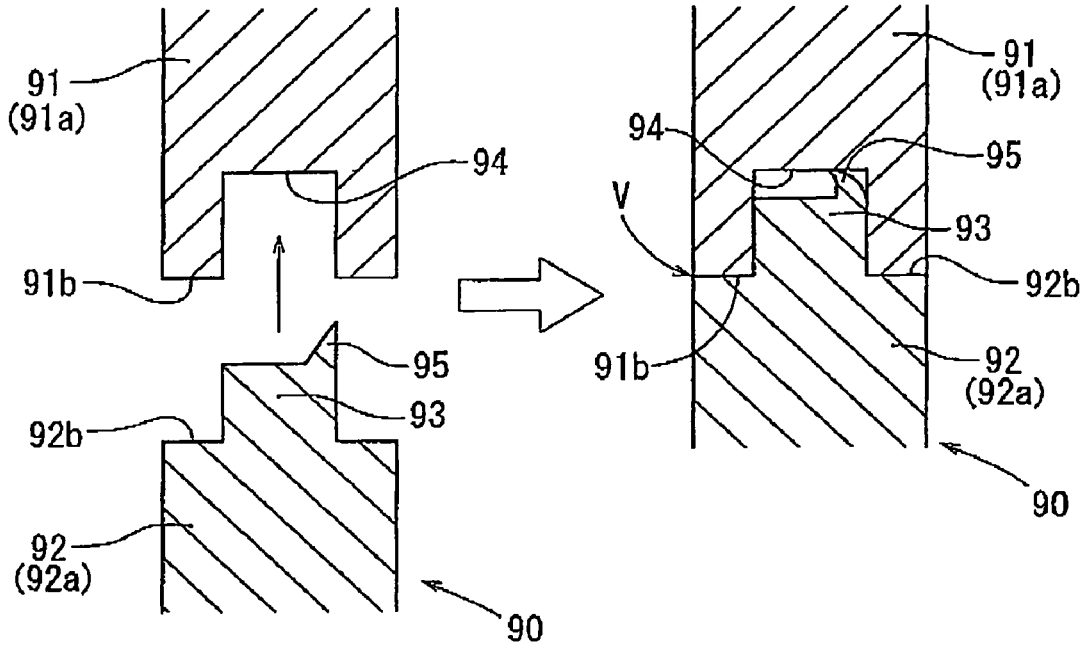
FIG. 5 is an explanatory view showing the operation for fitting a projection of one of housing halves of a housing into a recess of the other of the housing halves according to a second embodiment of the present invention.

With this arrangement, even in the event that a small gap V has been produced between the mating surfaces 91*b* and 92*b* and the oil contents of the grease contained with the gear chamber 53 has flown along the gap V, the seal portion 95 may prevent the oil contents from flowing to the outside of the housing 90 (in the direction from the left side to the right side of the projection 93 as viewed in FIG. 5). Therefore, no separate seal member is required. As a result, the number of parts may not be increased and the manufacturing costs may not be substantially increased.

In order to provide the seal portion 95, it is only necessary to form the seal portion 95 along the end face of the projection 93. Therefore, in the case that the housing halves 91 and 92 are molded by using dies, it is not necessary to substantially chance the configurations of the dies. Hence, the costs of the dies may not be substantially increased.

Although each of the first and second embodiments have been described in connection with a housing having left and right housing halves, the present invention may be applied to a housing having three ore more housing segments that are assembled together to form the housing.

Further, although the first and second embodiments have been described in connection with power tools (disk sanders) driven by the electric motor, the present invention also may be applied to pneumatically driven power tools that have an air motor driven by a compressed air.

This invention claims:

1. A housing for a power tool having a reduction gear mechanism coupled to a drive source for reducing a rotational output of the drive source, the housing comprising:

a first housing half having a first mating surface;

a second housing half having a second mating surface configured to be mated with the first mating surface of the first housing half within a plane extending substantially in a lengthwise direction of the power tool, while a gap is formed between the first and second mating surfaces, wherein:

each of the first and second housing halves includes an outer frame and an inner wall formed integrally with the outer frame;

the inner wall includes a first wall and a second wall;

the first walls of the first and second housing halves cooperate with each other to define at least a part of a gear chamber that can receive the reduction gear mechanism therein;

the second wall is formed in continuity with the first wall;

the outer frames of the first and second housing halves define a first part of the gap;

the first walls of the first and second housing halves define a second part of the gap;

the second walls of first and second housing halves define a third part of the gap;

the second wall of each of the first and second housing halves is connected to the corresponding outer frame in such a manner that the second wall intersects with the outer frame; and the first wall of each of the first and second housing halves is only connected to the outer frame via the second wall, so that the second part of the gap is connected to the first part via the third part; and a capillary action preventing device disposed in the third part of the gap or in a connecting point between the first part and the third part of the gap and constructed to interrupt a path of flow of a liquid caused by a capillary action along at least one of the first, second and third parts of the gap.

2. The housing as defined in claim 1, wherein the capillary action preventing device is disposed at the third part of the gap.

3. The housing as defined in claim 1, wherein the capillary action preventing device comprises a first recess formed in a part of the first mating surface of the first housing half defining the third part of the gap or the connecting point between the first part and the third part of the gap, so that the path of flow of the liquid is broadened by the first recess in a direction substantially perpendicular to the first mating surface.

4. The housing as defined in claim 3, wherein the capillary action preventing device further comprises a second recess formed in a part of the second mating surface of the second housing half defining the third part of the gap or the connecting point between the first part and the third part of the gap, so that the path of flow of the liquid is broadened by the second recess in a direction substantially perpendicular to the second mating surface.

5. The housing as defined in claim 4, wherein the first recess and the second recess are positioned to be opposed to each other.

6. The housing as defined in claim 1, wherein the capillary action preventing device comprises a porous material disposed within the at least one of the first, second and third parts of the gap.

7. The housing as defined in claim 1, wherein the capillary action preventing device comprises:

a recess formed in a part of the first mating surface of the first housing half defining the at least one of the first, second and third parts of the gap, and a projection formed on a part of the second mating surface of the second housing half defining the at least one of the first, second and third parts of the gap, wherein the projection comprises a seal portion resiliently deformable to sealingly contact with a bottom of the recess when the projection is engaged with the recess as the first and second housing halves are assembled with each other.

8. A housing for a power tool, comprising:

a plurality of housing segments assembled together to form the housing, wherein a gap is produced between mating surfaces of at least two housing segments positioned adjacent to each other; and a capillary action preventing device disposed at the gap and constructed to interrupt a path of flow of a liquid caused by a capillary action from the inside to the outside of the housing along the gap, wherein:

each of the housing segments includes an outer frame defining a part of an outer surface of the housing and an inner wall positioned inside of the outer frame, the inner wall having a first wall portion and a second wall portion, the second wall portion extending inwardly from the outer frame in such a manner that the second wall portion intersects with the outer frame;

the first wall portion of each of the housing segments is only connected to the outer frame via the second wall portion; and the capillary action preventing device is disposed in a part of the gap formed between the wall portions of the inner walls of the housing segments or at a part of the gap formed between intersecting portions where the wall portions intersect with the corresponding outer frames.

9. The housing as defined in claim 8, wherein the capillary action preventing device comprises a recess formed in at least one of the mating surfaces and configured to broaden the path of flow of the liquid in a direction substantially perpendicular to the mating surfaces.

10. The housing as defined in claim 8, wherein the capillary action preventing device comprises a porous material.

11. The housing as defined in claim 8, wherein the capillary action preventing device comprises:

a recess formed in one of the mating surface, and a projection formed integrally with the other of the mating surfaces and engaging the recess, wherein the projection includes a resiliently deformable portion that can sealingly contact an inner surface of the recess.

12. The housing as defined in claim 1, further comprising:

a bearing mounted to the first walls of the first and second housing halves, wherein the bearing rotatably supports a gear of the reduction gear mechanism.

13. The housing as defined in claim 1, wherein the capillary action preventing device includes a plurality of capillary action preventing devices spaced from each other in a longitudinal direction of the power tool.

14. The housing as defined in claim 13, wherein the second wall of each of the first and second housing halves includes a plurality of second walls spaced from each other in a longitudinal direction of the power tool.

15. The housing as defined in claim 8, wherein:

the power tool includes a reduction mechanism;

a bearing is mounted to the wall portions of the inner walls of the housing segments; and the bearing rotatably supports a gear of the reduction gear mechanism.

16. The housing as defined in claim 8, wherein the capillary action preventing device includes a plurality of capillary action preventing devices spaced from each other in a longitudinal direction of the power tool.

17. The housing as defined in claim 16, wherein the wall portion of each of the housing segments includes a plurality of wall portions spaced from each other in a longitudinal direction of the power tool.

* * * * *